US007322290B2

(12) United States Patent
Zink

(10) Patent No.: US 7,322,290 B2
(45) Date of Patent: Jan. 29, 2008

(54) METHOD FOR CHANGING AT LEAST ONE PRINTING PLATE AND A PRINTING PRESS COMPRISING SEVERAL PLATE CYLINDERS

(75) Inventor: Wolfgang Peter Zink, Theres (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 353 days.

(21) Appl. No.: 10/525,086

(22) PCT Filed: Aug. 6, 2003

(86) PCT No.: PCT/DE03/02636

§ 371 (c)(1),
(2), (4) Date: Feb. 22, 2005

(87) PCT Pub. No.: WO2004/020203

PCT Pub. Date: Mar. 11, 2004

(65) Prior Publication Data

US 2006/0005726 A1 Jan. 12, 2006

(30) Foreign Application Priority Data

Aug. 21, 2002 (DE) ..... 102 38 105

(51) Int. Cl.
*B41L 47/14* (2006.01)
*B41F 27/12* (2006.01)

(52) U.S. Cl. ..... 101/477; 101/415.1

(58) Field of Classification Search ..... 101/477, 101/484, 247

See application file for complete search history.

(56) References Cited

U.S. PATENT DOCUMENTS

| | | | |
|---|---|---|---|
| 5,063,844 | A | 11/1991 | Fausel |
| 5,111,744 | A | 5/1992 | Wieland |
| 5,127,328 | A | 7/1992 | Wieland |
| 5,289,775 | A | 3/1994 | Spiegel et al. |
| 5,526,747 | A | 6/1996 | Marmin et al. |
| 5,537,926 | A | 7/1996 | Beisel et al. |
| 5,560,298 | A | 10/1996 | Krokolinski et al. |
| 5,595,119 | A | 1/1997 | Hada et al. |
| 5,595,120 | A | 1/1997 | Metrope |
| 5,701,822 | A | 12/1997 | Metrope |
| 5,758,579 | A | 6/1998 | Marmin et al. |
| 5,983,794 | A | 11/1999 | Emery |
| 6,142,072 | A | 11/2000 | Rudewitz et al. |
| 6,205,926 | B1 | 3/2001 | Dufour |
| 6,345,575 | B1 | 2/2002 | Metrope |

(Continued)

FOREIGN PATENT DOCUMENTS

DE 39 40 795 A1 6/1991

(Continued)

*Primary Examiner*—Leslie J. Evanisko
(74) *Attorney, Agent, or Firm*—Jones, Tullar & Cooper P.C.

(57) ABSTRACT

A printing press has several plate cylinders on which printing plates can be placed and from which they can be removed. Changing of these printing plates is accomplished by remote control through the use of a central controller which is associated with the printing press. The central controller is in control of all of the units which are involved in the changing of the printing press. At least one printing plate on at least one of the plate cylinders can be changed while the press is in operation.

24 Claims, 8 Drawing Sheets

U.S. PATENT DOCUMENTS 6,425,330 B1 7/2002 Weber et al.

FOREIGN PATENT DOCUMENTS

| | | | |
|---|---|---|---|
| DE | 39 40 796 | A1 | 6/1991 |
| DE | 41 30 359 A 1 | | 3/1993 |
| DE | 42 24 832 | A1 | 3/1993 |
| DE | 43 22 027 A 1 | | 7/1993 |
| DE | 93 11 113.4 | | 10/1993 |
| DE | 44 47 088 | C1 | 2/1996 |
| DE | 196 03 663 | A1 | 8/1997 |
| DE | 198 03 726 | A1 | 8/1999 |
| DE | 199 41 235 | A1 | 4/2000 |
| DE | 199 34 271 | A1 | 5/2000 |
| DE | 199 33 943 A 1 | | 1/2001 |
| DE | 100 08 936 | A1 | 8/2001 |
| EP | 0 678 382 | A1 | 10/1995 |
| EP | 0 678 383 | A1 | 10/1995 |
| EP | 0 734 859 | A1 | 10/1996 |
| EP | 0 734 860 | A1 | 10/1996 |
| EP | 1 084 837 | A1 | 3/2001 |
| EP | 1 155 840 | A2 | 11/2001 |
| GB | 2 309 668 | A | 8/1997 |
| JP | 2000-94640 | | 4/2000 |
| WO | 199 42 619 | A1 | 4/2000 |

METHOD FOR CHANGING AT LEAST ONE PRINTING PLATE AND A PRINTING PRESS COMPRISING SEVERAL PLATE CYLINDERS

CROSS-REFERENCE TO RELATED APPLICATIONS

This U.S. patent application is the U.S. national phase, under 35 USC 371, of PCT/DE2003/002636, filed Aug. 6, 2003; published as WO 2004/020203 A1 on Mar. 11, 2004, and claiming priority to DE 102 38 105.4, filed Aug. 21, 2002, the disclosures of which are expressly incorporated herein by reference.

FIELD OF THE INVENTION

The present invention is directed to a method for changing at least one printing plate or forme, and to a printing press with several forme cylinders. The changing of the printing plate on the plate or forme cylinder is controlled remotely by a central controller.

A method and an arrangement for the automatic feeding of a printing plate to a plate cylinder, or for the removal from a plate cylinder of a rotary printing press is known from DE 39 40 795 A1. That method for the automatic feeding of a printing plate to a plate cylinder of a rotary printing press, in which the plate cylinder has, inter alia, assemblies for clamping and for bracing or tensioning the printing plate, provides for the printing plate to be placed into a storage chamber of printing plate feeding or removal device. The plate cylinder is rotated into a plate feeding position, and the printing plate is conducted to a clamping device of the plate cylinder by the use of a number of transport rollers. The above-identified method for the automatic removal of a printing plate from a plate cylinder of a rotary printing press, in which the plate cylinder has, inter alia, assemblies for unclamping and releasing the printing plate, is distinguished in that the plate cylinder is initially rotated forward into a printing plate release position. A clamping flap for grasping a printing plate leading end is then opened. The plate cylinder then rotates backward, and a clamping flap for grasping a printing plate starting end is opened. The printing plate is then conducted to a storage chamber of a printing plate feeding or removal device by the use of a number of transport rollers. The device for performing the above-described method has at least one transport roller embodied as a drive roller and one embodied as a pressing roller, and wherein the pressing roller can be placed against the drive roller. In addition, various actuating devices, a pivotably seated pressing roller for pressing the printing plate against the plate cylinder, as well as ejection fingers, can be provided. The ejection fingers can have tips, which are arranged so that they can be pivoted into the periphery of the plate cylinder. Also, the storage chamber of the printing plate feeding or removal device can be seated, pivotable around a joint.

DE 39 40 796 A1 describes an arrangement for automatically changing a printing plate on a plate cylinder of a rotary printing press. The plate cylinder has, inter alia, devices for clamping and for bracing the printing plate. The printing plate changing arrangement has at least two storage chambers. A printing plate released from the plate cylinder can be conducted into a storage chamber by transport rollers, while a printing plate stored in the other storage chamber is fed to a clamping device of the plate cylinder by transport rollers.

EP 1 084 837 A1 describes a device for holding and conveying a printing forme. This device has translatory conveying arrangements, which convey a printing forme to be mounted on a forme cylinder, or a printing forme to be removed from a forme cylinder. For changing a printing forme, the device is tilted around an axis of rotation out of its position of rest into its operating position. A hook is pivoted, merely under its own weight, into the space in which the printing forme is stored and secures the printing forme at its trailing beveled end to prevent it from inadvertently falling out of this space.

EP 0 734 859 A1 describes an arrangement for changing printing formes. For changing printing formes, a printing forme loading unit pivots out of a vertical position of rest against a holding element, which is embodied as a gripper. For mounting printing formes, the holding element grasps a fresh printing forme kept ready in the printing forme loading unit and performs, together with the grasped printing forme, a pivot movement by the useof an actuated lift cylinder. In this way, the printing forme, which is seated straight in a printing forme supply compartment, is lifted by its front area by the pivoting movement of the holding element, so that the leading end of the printing forme hangs down. The curved printing forme grasped by the holding element is pivoted by the holding element, with its leading end against a forme cylinder, in such a way that a suspension leg, which is formed at the leading end of the printing forme, can drop into a channel that is formed in the forme cylinder, which channel has a proportionally large opening width in comparison with the diameter of the forme cylinder.

A pivotable printing forme changing arrangement is known from DE 199 34 271 A1. A printing forme, which is fixed in place on a printing forme table by a contact body by frictional contact, is placed against a printing forme cylinder by a pivoting movement of the printing forme table. An end of the printing forme, projecting past the printing forme table, is deformed when an edge formed at the end of the printing forme is placed against the printing forme cylinder. The end, which has been prestressed in this way, snaps into a bracing groove of the printing forme cylinder when the printing forme cylinder is slowly rotated. In the course of this procedure, no relative movement takes place between the printing forme resting on the printing table and the contact body.

An arrangement for changing printing formes of rotary printing presses is known from EP 0 678 383 A1. Pivotable holding elements, which can be charged with a vacuum, pull a leading end of a printing forme to be mounted on a forme cylinder to the forme cylinder and place this end, which is elastically deformed, against the forme cylinder. In the course of rotation of the forme cylinder, a beveled edge at the leading end of the printing forme snaps into an opening in the cylinder. A force need for this snapping in of the front edge of the printing forme is supplied by the holding elements.

A device for exchanging printing formes of rotary printing presses is known from EP 0 678 382 A1. Holding elements, which can be charged with a vacuum, place a leading end of a printing forme to be mounted on a forme cylinder against the forme cylinder by exerting a contact pressure, because of which contact pressure this end is deformed. The contact pressure causes a beveled edge at the leading end of the printing forme, which beveled edge is prestressed in this manner, to snap into an opening of the cylinder while the latter rotates.

A device for changing printing formes is known from EP 0 734 860 A1. Pivotable holding devices, which preferably can be charged with a vacuum, place a leading end of a printing forme to be mounted on the forme cylinder against the forme cylinder, because of which placement this end is elastically deformed.

Devices for changing printing formes are known from both EP 1 155 840 A2 and JP 2000-094 640 AA. A beveled edge, located at the leading end of a printing forme to be mounted on a forme cylinder, after this beveled end has been placed against the forme cylinder, is pressed into an opening in the cylinder by a rolling element. With the device in accordance with EP 1 155 840 A2, the printing forme to be mounted is conveyed out of a magazine by a thrusting force acting on the trailing end of this printing forme and is placed against the forme cylinder by making use of the elasticity of the printing forme. With the device in accordance with JP 2000-094 640 AA, the beveled edge at the leading end of the printing forme to be mounted, is placed against the lower half of the forme cylinder and is pushed, counter to the force of gravity, into the opening of the cylinder.

A method and a device for mounting a flexible printing forme is known from DE 44 47 088 C1. A feed carriage, which can be moved radially and axially in front of the cylinder and which has an insertion slider for mounting a suspension leg at the trailing end of the printing forme can be fixed in place in a defined position in relation to the cylinder by a preferably conical snap-in bolt. This bolt, which engages an opening of the cylinder, is radially movable, but is otherwise fixed on the frame.

A device for positioning a magazine, which is used for automatic printing plate changing, is known from DE 42 24 832 C2. The vertical adjustability of the magazine in the plate changing position is fixed in place bya bolt.

A displaceable suspension for a protective printing group device is known from DE 198 03 726 A1. The protective printing group device has displaceable bolts and a device actuating the bolts. For arresting the protective printing group device in place, the bolts are introduced into lateral frame walls of a printing group.

A printing group for the flying printing plate change at a web-fed offset printing press is known from each of DE 196 03 363 A1 and DE 199 42 619 A1. A contact and release mechanism is provided, by the use of which, the plate cylinder can be moved away from its assigned rubber blanket cylinder for a plate change.

SUMMARY OF THE INVENTION

The object of the present invention is directed to providing a method for changing at least one printing forme and to providing a printing press with several forme cylinders.

In accordance with the present invention, this object is attained by separating a forme cylinder carrying the printing forme from its associated transfer cylinder for an appropriate length of time. At least one printing forme carrying chute is moved from a rest position to a working position against the forme cylinder. A suitable printing forme conveying device in the chute is actuated to either pick up a used forme from the cylinder, or to supply a fresh forme to the cylinder. Separation of the cylinders, movement of the chute and operation of the conveying device is all accomplished from a central control device by remote control. The chutes assigned to ones of the forme cylinders are movable between their rest and working positions as a function of which cylinders are in and out of production.

The advantage to be gained by the present invention consists, in particular, in that dressings on a cylinder can be rapidly and dependably changed with the least possible outlay for apparatus while the production by the printing press is running. In one embodiment of the present invention, the change takes place without the use of a pressing element, because of which a particularly simple structural set-up becomes possible. Because the printing formes are placed in a defined position, in relation to the printing forme magazine, prior to the feeding in of a printing forme, no assembly for use in aligning the printing forme to be mounted is required at the forme cylinder itself. The printing forme is conducted into its desired position for mounting on the forme cylinder by the use of a structurally simple carriage, on which carriage the printing forme rests merely because of its weight. The simple and unhampered mobility of the printing forme magazine, to be positioned in front of the forme cylinder, is advantageously provided by a connecting element, which combines all of the required connecting lines in a bundle. All of the movements which are required for changing a printing forme, i.e. the progression of the movements of all of the units involved in this change, is possible from a preferably central control device that is assigned to the printing press. An operator does not need to perform any work, during the printing forme change, at the running printing press.

BRIEF DESCRIPTION OF THE DRAWINGS

Preferred embodiments of the present invention are represented in the drawings and will be described in greater detail in what follows.

Shown are in:

FIG. 1, a perspective representation of a dressing, in

DESCRIPTION OF THE PREFERRED EMBODIMENTS

Figure 1:
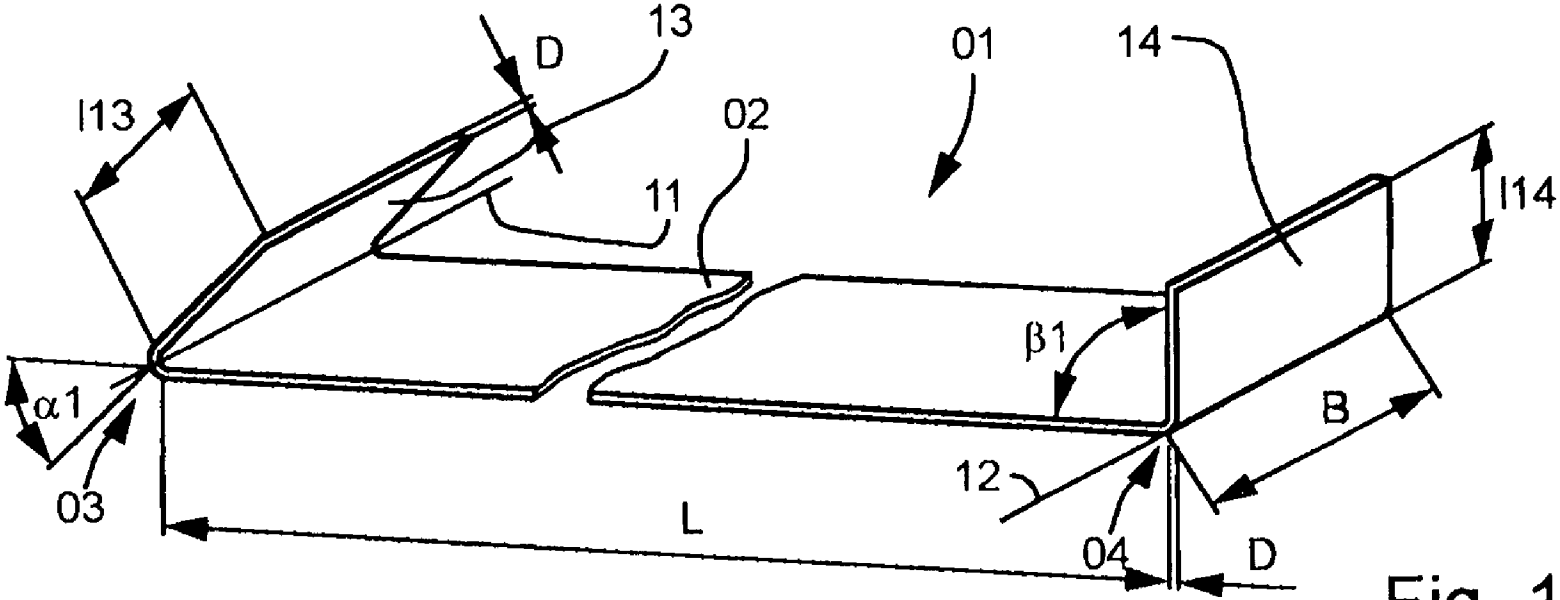
Figure 2:
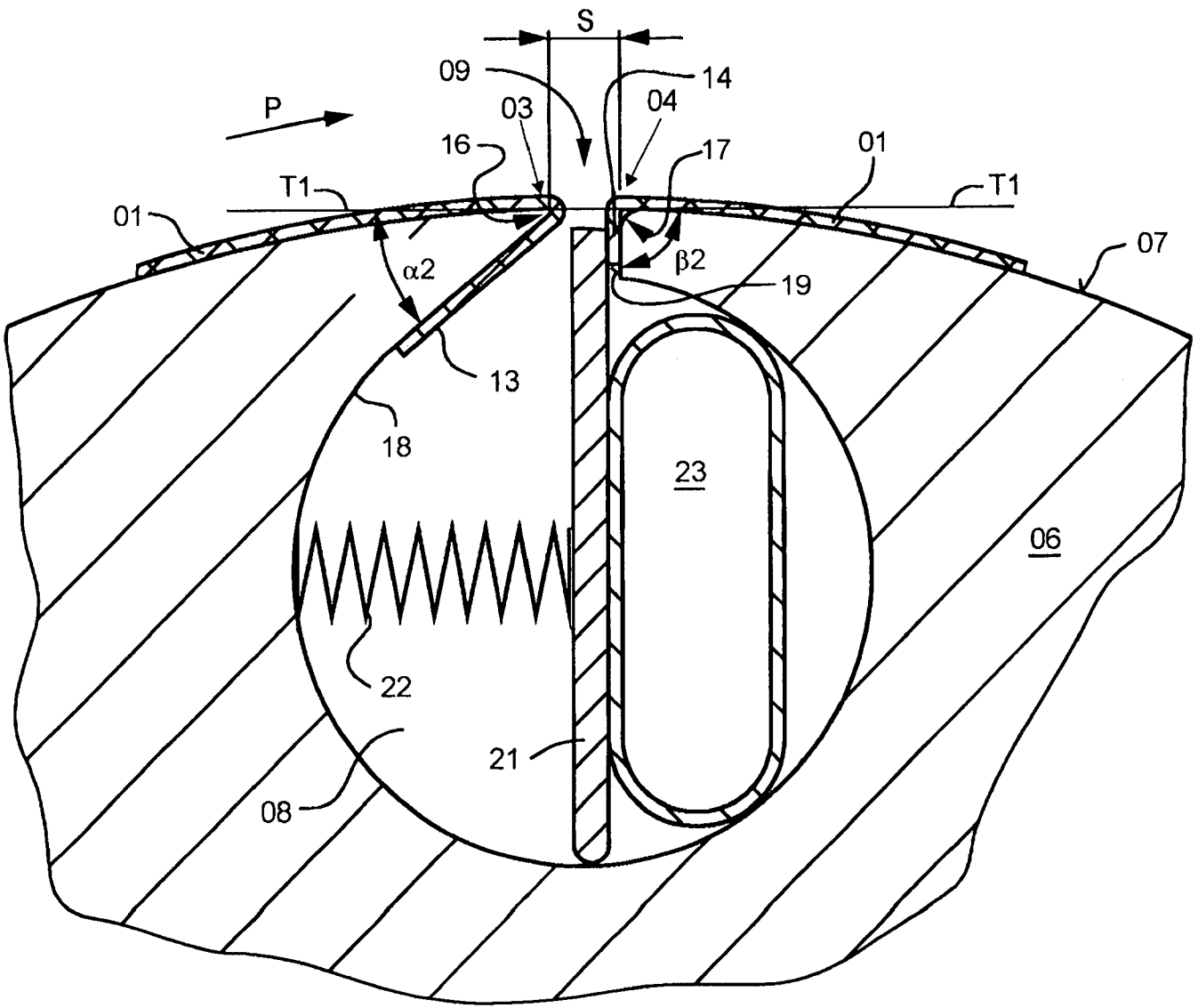
FIG. 2, a simplified cross-sectional representation of a holding device for a dressing to be mounted on a cylinder, in FIG. 3, dressings which are brought tangentially against the cylinder, and on which a radial force acts during their being mounted, in FIG. 4, elastically prestressed dressings in the course of their being mounted on a cylinder, in FIG. 5, a 4-cylinder printing press with horizontal paper guidance and with printing forme magazines, in FIG. 6, a printing forme magazine with a conveying device for a used printing forme, in FIG. 7, a printing forme magazine with an inclined lifting device for conveying a fresh printing forme, in FIG. 8, a device in a printing forme magazine for aligning a fresh printing forme with respect to a forme cylinder, in FIG. 9, a printing forme, whose leading end rests on a forme cylinder in the course of the printing forme being mounted, in FIG. 10, a printing forme magazine with a fresh printing forme, which fresh printing forme rests with its print side on a support, in FIG. 11, a printing forme magazine with a conveying device for a used printing forme, in FIG. 12, a cross-sectional representation of a printing forme magazine with a friction body placed against a printing forme, and in FIG. 13, a friction body guided in a channel, and in which the channel is provided with cutouts.

Referring initially to FIG. 1, dressing 01, which is configured as a plate-shaped printing forme 01, or as a support plate supporting a printing blanket, has a substantially rectangular surface of a length L and a width B. The length L can assume, for example, a measured values between 400 mm and 1300 mm, and the width B has a measured values, for example, between 280 mm and 1500 mm. The generally rectangular surface has a support side, called support side or surface 02 in what follows, with which support side or surface 02, in the dressing mounted state, the dressing 01 rests on a surface area 07 of a cylinder 06, as seen in FIG. 2. The back or inverse of the support surface 02 is a work surface which, in the case in which the dressing 01 is embodied as a printing forme 01, is provided with a printing image, or which can at least be provided with a printing image. The dressing 01 has two oppositely located ends 03, 04, which delimit the support surface 02. Angled or beveled suspension legs 13, 14 extend from dressing ends 03, 04 respectively, and each such leg 13, 14 preferably extends entirely, or at least partially, over the width of the dressing 01. The support surface 02 of the dressing is flexible at least along the length L and can be matched to the curvature of the surface 07 of a cylinder 06, as seen in FIG. 2, when the dressing 01 is being fastened on a surface area 07 of a cylinder 06 of a printing press. In the mounted state of the printing forme, the length L of the support surface 02 thus extends in a direction of the circumference of the cylinder 06, while the width B of the support surface 02 extends in the axial direction of the cylinder 06. In actual use, the measurement of the width B of dressing 01, in particular, varies within defined predetermined tolerance limits, since the original width B of the dressing 01 is typically reduced by effecting a trimming of at least one of the longitudinal sides of the dressing 01. This trimming may be done, for example, for adjusting a position of a printing image on the working surface of the dressing 01 to a defined distance measurement with respect to at least one of the long sides of the dressing 01. Here, the tolerance limits lie, for example, within a range between fractions of a millimeter and up to a few millimeters. Thus, the width B of the dressing 01 can differ from other identical dressings 01 used on the same cylinder 06 within the permissible tolerance limits.

As represented in FIG. 2, the suspension legs 13,14 of the dressing 01 are fastened by the provision of a holding device. Such a holding device is conventionally arranged in a channel 08, and wherein, as a rule, the channel 08 extends in a axial direction in relation to the cylinder 06. An end 03 of the dressing 01, which end 03 is aligned in the production direction P of the cylinder 06, is called its leading end 03, while the oppositely located end 04 is referred to as the trailing end 04 of the dressing 01. At least the ends 03, 04 of the dressing 01, with the suspension legs 13, 14 formed thereon, consist of a rigid, such as a metallic material, and particularly, for example, of an aluminum alloy. A thickness D of the material of the dressing 01, as seen in FIG. 1, or the thickness D of at least the suspension legs 13, 14 is customarily a few tenths of a millimeter, for example is 0.2 mm to 0.4 mm, and preferably is 0.3 mm. Thus, the dressing 01, as a whole, or at least its ends 03, 04, consists of a dimensionally stable material. The ends 03, 04 of dressing 01 can be permanently deformed by bending against a material-specific resistance.

A beveled suspension leg 13 14 is formed on at least one end 03 of the dressing 01, as seen in FIG. 1. Preferably, such beveled suspension legs 13, 14 are formed, but preferably on both dressing ends 03, 04, each along a bent edge 11, 12, respectively. The suspension legs 13, 14 can each be inserted into a narrow opening 09, which, in particular, is embodied in a slit shape, of the channel 08 of the cylinder 06, again as seen in FIG. 2. The suspension legs can each be fastened in opening 09, by, for example use of a holding device. For example, in relation to the length L of the not arched flat support surface 02 of the not mounted dressing 01, a suspension leg 13 at the bending edge 11 at the leading end 03 of the dressing is beveled at an opening angle $\alpha$1. The trailing end 04 of dressing 01 has a suspension leg 14 which is beveled at an opening angle $\beta$1, all as seen in FIG. 1. The opening angles $\alpha$1, $\beta$1, as a rule, lie between 30° and 140°. If the opening angle $\alpha$1 is assigned to the leading end 03 of the dressing 01, it is preferably configured as an acute angle. In particular, it is 45°. The opening angle $\beta$1 at the trailing end 04 of the dressing 01 is often configured to be greater than 80°, or as an obtuse angle. In particular, it is between 85° and 135°. The beveled suspension leg 13 at the leading end 03 of dressing 01 has a length I13, which, for example, lies in the range between 4 mm and 30 mm, and in particular is between 4 mm and 15 mm. The beveled suspension leg 14 at the trailing end 04 of dressing 01 has a length I14, which is between 4 mm and 30 mm, for example, and in particular is between 8 mm and 12 mm. A shorter length is rather preferred in order to assure as simple as possible a removal of the suspension legs 13, 14 from the opening 09 of the channel 08.

FIG. 2 shows, in a simplified sectional representation, a cylinder 06 with a surface area 07 and with a channel 08, which channel 08 has a narrow, slit-shaped opening 09 of a slit width S facing toward the surface area 07, wherein the slit width S is less than 5 mm and preferably lies within the range of 1 mm to 3 mm. In the production direction P of the cylinder 06, the opening 09 has an opening front edge 16 and an opening rear edge 17. An acute opening angle $\alpha$2, which lies between 30° and 50°, and is preferably 45°, is formed between an opening wall 18 extending from the opening front edge 16 in the direction toward the channel 08, and an imagined tangential line T1 resting on the opening 09 in the surface area 07 of the cylinder 06. Thus, the beveled suspension leg 13 at the leading end 03 of the dressing 01 can be suspended on this front edge 16 of the opening 09, preferably positively connected, because the opening angle $\alpha$1 at the leading end 03 of the dressing 01 is preferably matched to the opening angle $\alpha$2 of the leading opening wall. Conditions are the same at the trailing end 04 of the dressing 01. Between the wall 19 extending from the rear edge 17 in the direction toward the channel 08, and an imagined tangential line T1 resting on the opening 09 in the surface area 07 of the cylinder 06, an opening angle $\beta$2 has been formed, which opening angle $\beta$2 lies either between 80° and 95°, and is preferably 90°, or lies between 120° and 150°, and is preferably 135°. Thus, the beveled suspension leg 14 at the trailing end 04 of the dressing 01 can be suspended on this rear edge 17 of the opening 09, preferably positively connected, because the opening angle $\beta$1 at the trailing end 04 of the dressing 01 is at least approximately matched to the opening angle $\beta$2 at the opening trailing wall 19.

A preferably pivotably seated dressing end holding member 21 and a preferably prestressed spring element 22, for example, are arranged in the channel 08. The spring element 22 presses the holding member 21 against, for example, the beveled suspension leg 14 at the trailing end 04, which trailing end beveled suspension leg 14 is suspended at the rear edge 17 of the opening 09. The suspension leg 14 at the trailing end 04 of dressing 01 is maintained at the wall 19 extending from the rear edge 17 in the direction toward the channel 08. For use in releasing the pressure exerted by the holding member 21, an actuating device 23 is provided in the channel 08 which actuating device 23, when actuated, pivots the holding member 21 against the force of the spring element 22. Thus, the holding device substantially consists of the holding member 21, the spring element 22 and the actuating device 23. Preferably the holding member 21 can be actuated by remote control by use of the actuating device 23.

The cylinder 06, which has hereinabove been described by way of example, can be structured in such a way that several, preferably identical dressings 01 can be arranged on its surface area 07. If the cylinder 06 is configured as a forme cylinder, it can be covered, in its axial direction, with, for example, six side-by-side arranged plate-shaped printing formes 01. It can also be provided that more than one dressing 01 which can be applied to the cylinder 06 in the direction of its circumference. For example, two channels 08, each extending axially with respect to the cylinder 06 and each having associated openings 09, can be provided, which two channels 08 are arranged, offset by 180° with respect to each other, on the circumference of the cylinder 06. With this coverage of the cylinder 06 by two dressings 01 which are arranged one behind the other along the cylinder's circumference, a suspension leading leg 13 of a leading end 03 of one dressing 01 is fastened in the first channel 08, while a suspension trailing leg 14 of a trailing end 04 of the same dressing 01 is fastened in the other channel 08. This correspondingly applies to the remaining dressing, or dressings, 01 arranged on this cylinder 06. Also, the dressings 01, which may be arranged side-by-side in the axial direction of the cylinder 06, can be arranged offset with respect to each other, for example individually or in groups each by one-half the length L of the dressing 01. This, however, requires that further channels 08 with associated openings 09, or at least partial lengths thereof, have been cut into the cylinder 06 and are arranged, for example offset by 90° with respect to the two previously mentioned channels 08 and openings 09, along the circumference of the cylinder 06.

Figure 3:
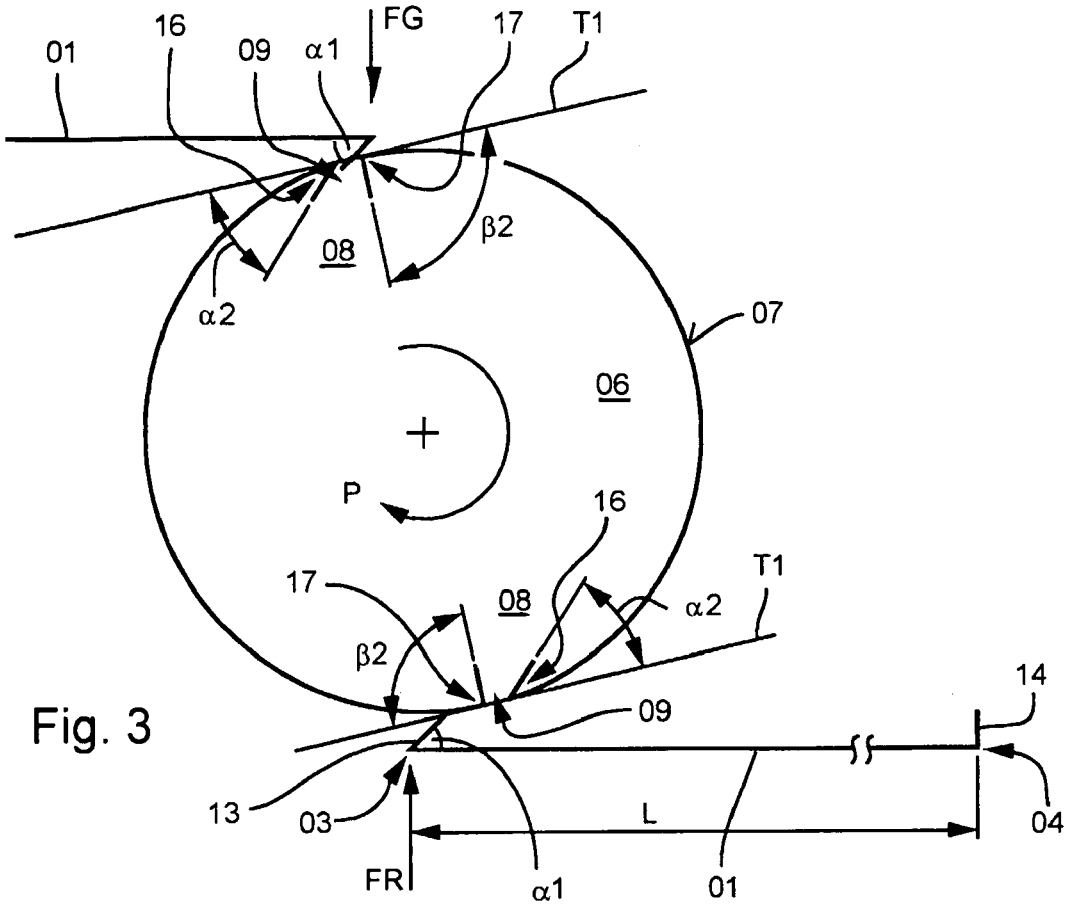

A method for mounting a flexible dressing 01 on a cylinder 06 of a printing press, in accordance with the present invention, will be described in what follows. The dressing has a leading end 03 and a trailing end 04 in relation to the production direction P of the cylinder 06, as seen in FIG. 3. A suspension leg 13 is formed at least at the leading end 03 of the dressing 01. This suspension leg 13 is beveled at an opening angle $\alpha$1 of maximally 90°, and preferably of 45°, with respect to the extended length L of the dressing 01. At least one, preferably slit-shaped opening 09 with a first edge 16 and with a second edge 17, in the production direction P of the cylinder 06, is provided in the cylinder 06. These edges 16, 17 preferably extend parallel with each other in the axial direction of the cylinder 06. The method in accordance with the present invention is distinguished because the leading end 03 of the dressing 01 is fed, preferably tangentially, in the cylinder's production direction P, to the cylinder 06 preferably by the use of a pushing force that is preferably acting at the trailing end 04 of the dressing 01. The suspension leg 13 at the dressing leading edge 03 is placed against the cylinder 06 behind the second, trailing edge 17 of the opening 09, so that, in the course of a rotation of the cylinder 06 in its production direction P, the suspension leg 13 formed at the dressing leading edge 03 extends into the opening 09, as a result of a radial force RF acting on the leading end 03, and directed toward the cylinder 06. Suspension leading leg 13 is hooked on the first edge 16 preferably by being positively connected there. The pushing force used for conveying the dressing 01 is advantageously a force acting in the plane of the dressing 01 in the mounting direction M of the latter.

In the case where the dressing 01 rests, with its suspension leg 13 formed on the leading end 03, on the surface area 07 on the cylinder 06, and supporting itself thereon, the radial force RF can be the force FG of the weight of the dressing 01 acting on the surface area 07 of the cylinder 06. In this case, it is advantageous to conduct the dressing 01 straight over its extended length L, or at least without a bend oriented toward the cylinder 06, to the upper half of the surface area 07 of the cylinder 06 and to place the suspension leg 13 at the leading end 03 on a contact point 27 of the surface area 07 of the cylinder 06, as seen in FIG. 3. As soon as the dressing leading end suspension leg 13 and the opening 09 of the cylinder 06 are located opposite each other, because a spacing a09 between the opening 09 and the contact point 27 is canceled, i.e. is reduced to zero by a relative movement between the opening 09 and the contact point 27 in the circumferential direction, the suspension leg 13 at the leading end 03 of the dressing 01 falls, primarily with a proportion of over 70% of the sum of all forces acting on the suspension leg 13, and dependably into the opening 09 of the cylinder 06 because of the force FG of its weight acting on the leading end 03. This is accomplished without requiring a prestressing of the leading end 03 of the dressing 01 by making use of the elasticity of the dressing 01, and without the use of further aids, such as a rolling element.

Figure 4:
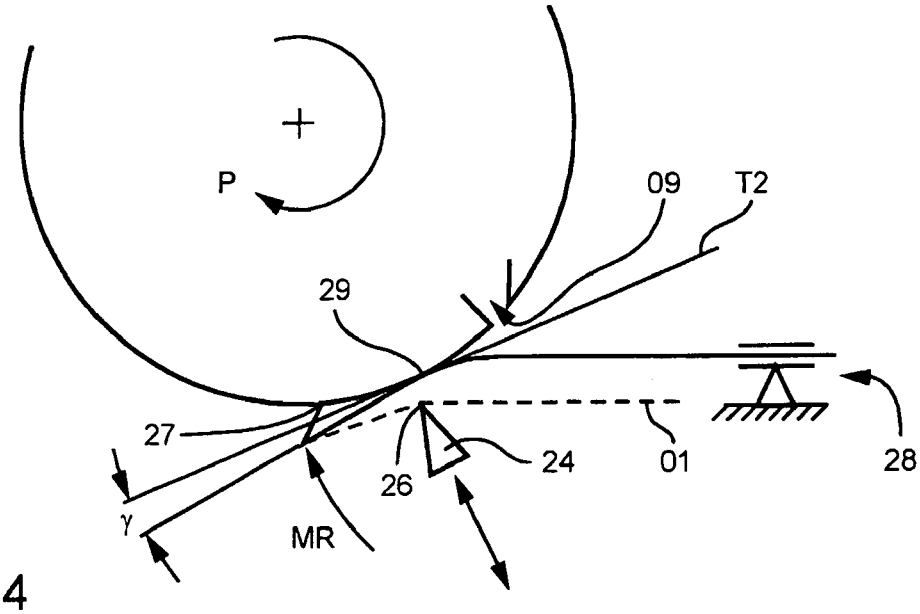

In addition to the use of the force FG of the weight of the dressing 01, or as an adjunct to it, the leading end 03 of dressing 01 can be simply prestressed FIG. 04, so that the suspension leg 13, formed at the leading end 03 of the dressing 01, springs into the opening 09 because of a restoring moment MR directed toward the cylinder 06. This occurs as soon as the opening 09 of the cylinder 06, and the contact line 27 of the suspension leg 13 with the surface area 07 of the cylinder 06, are located directly opposite each other as a result of a relative movement between the dressing 01 and the cylinder 06, which relative movement takes place, in particular, by rotation of the cylinder 06 in the production direction P.

Figure 6:
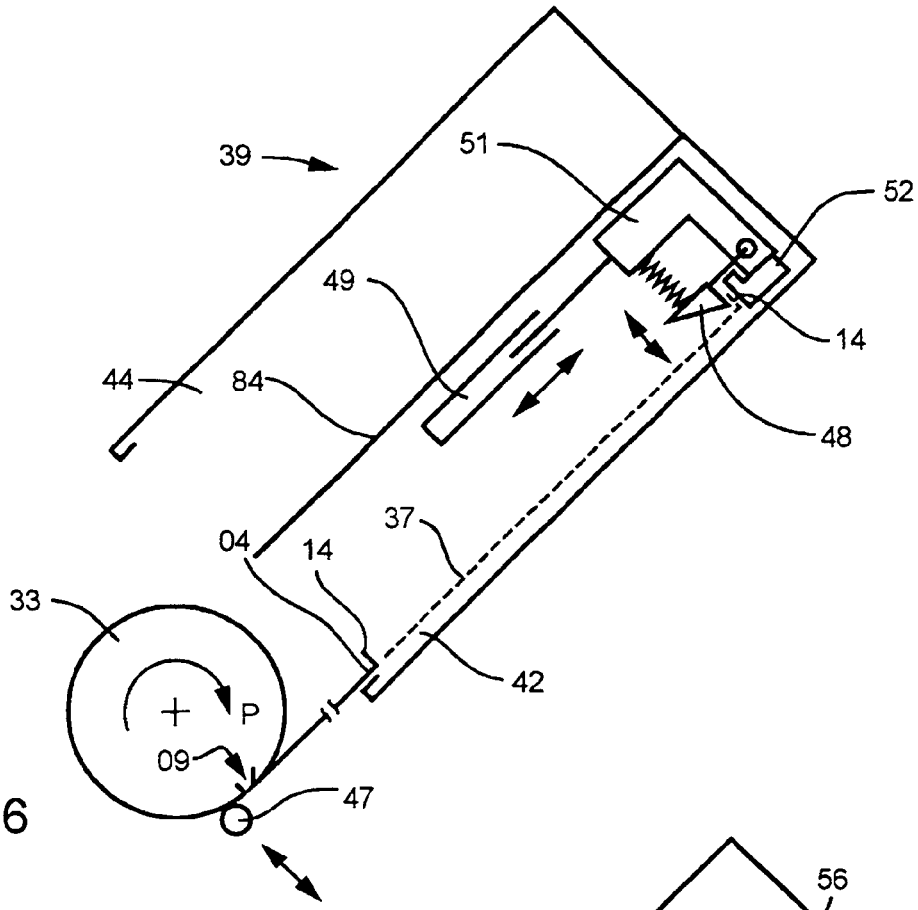
Figure 9:
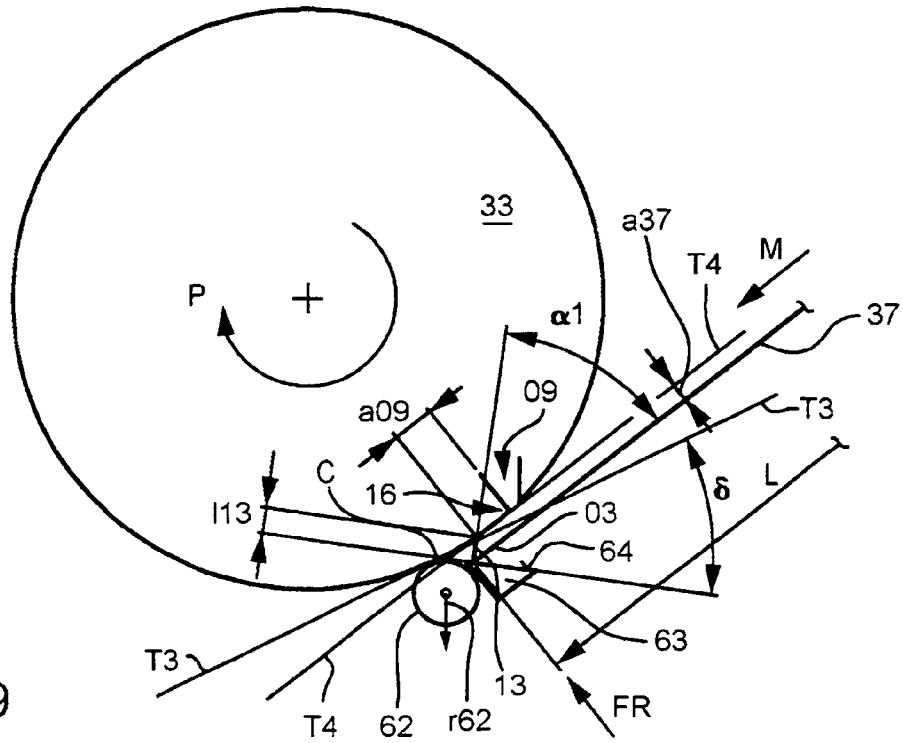

The restoring moment MR results from the fact that the dressing 01 consists of an elastically deformable material and therefore inherently has an elastically resilient property. This property can be utilized because, in the course of bringing the leading end 03 of the dressing 01 to the cylinder 06, the dressing 01 is conducted, for example, over an edge 26 of a support element 24, which support element 24 is preferably extending in the axial direction of the cylinder 06 and is spaced apart from the cylinder 06. Dressing 01 is bent there in such a way that a bending stress with a spring force directed toward the cylinder 06, shown in the dashed line representation of the dressing 01 in FIG. 4 is built up at the leading end 03 of the dressing 01. At least until the leading end 03 of the dressing 01, which is conducted over the edge 26 of the support element 24, rests on the surface area 07 of the cylinder 06, the dressing 01 is fed, with force exerted on its trailing end 04, from a spatial direction which is fixed with respect to the cylinder 06. In this way, the dressing 01 is stabilized during the mounting process along its contact line 27 of its suspension leg 13, attached to the leading end 03, with the surface area 07 of the cylinder 06, as well as by its support on the edge 26 of the support element 24 and by a positional fixation of the dressing trailing end 04. The support element 24 can be a rolling element 24, for example, which can be placed against the cylinder 06, for example. In this case, the support element 24 is preferably arranged close to the cylinder 06. However, it is also possible to provide, in addition to the support element 24, a further rolling element 47 or 62, such as is seen in FIG. 6 or 9, and which will be discussed later, wherein the support element 24 can be arranged at a different position and need not be capable of being placed against the cylinder 06. For example, in this case shown in FIG. 4, the purpose of the support element 24 can be limited to generating a bending stress in the dressing 01.

The leading end 03 of the dressing 01 can also be brought toward the cylinder 06 in such a way that, after its contact with the surface area 07 of the cylinder 06, this leading end 03 faces away from the surface area 07 of the cylinder 06 at an acute angle γ with respect to an imagined second contact line T2 resting at a contact point 29 on the surface area 07 of the cylinder 06 referring, in this context to the representation of the dressing 01 by a solid line in FIG. 4. However, the bending of the leading end 03 of the dressing 01 should only be forceful enough so that the suspension leg 13 formed at leading end 03 still rests securely against the surface area 07 of the cylinder 06. For aiding the secure resting of the suspension leg 13 against the surface area 07 of the cylinder 06 it is possible, for example, to place the support element 24 against the dressing 01, because of which placement, the leading end 03 of the dressing 01 is maintained close to the surface area 07 of the cylinder 06.

In the course of a relative movement between the cylinder 06 and the dressing 01, preferably during the rotation of the cylinder 06 in its production direction P, but also possibly just as well during a suitable movement of the dressing 01, for example during a dressing movement counter to the production direction P of the cylinder 06, the suspension leg 13 at the leading end 03 of the dressing 01 is hooked on the first edge 16 of the opening 09 A rolling element 24, which is placed against the cylinder 06, can support the mounting of the dressing 01 on the cylinder 06 since the rolling element 24 rolls the dressing 01 up on the cylinder 06. A suspension leg 14 is formed, for example, at the trailing end 04 of the dressing 01, and this trailing end suspension leg 14 is pressed into the opening 09 of the cylinder 06 in the course of rolling the dressing 01 up on the cylinder 06.

A device for executing the above-described method will now be explained by way of an example of a web-fed offset jobbing printing press with, for example, an upright rubber-against-rubber printing group in 4-cylinder construction and with a horizontal guidance of a material 46 to be imprinted, such as a paper web 46, as depicted schematically in FIG. 5. In in this example, a first pair of cylinders 31, 32 is provided, which first pair of cylinders 31, 32 roll off on each other underneath the paper web 46 and consist of a forme cylinder 31 and a rubber blanket cylinder 32. A second pair of cylinders 33, 34, which also roll off on each other, are arranged above the paper web 46 and consist of a forme cylinder 33 and a rubber blanket cylinder 34. The paper web 46 is conducted between the two rubber blanket cylinder 32, 34, which are placed against each other. Preferably several, for example five or six, separate print positions at each side of the paper web 46 for differently colored ink are provided in the printing press. In the running direction of the paper web 46, several printing groups are arranged one behind the other. In particular, more forme cylinders 31, 33, or even several entire printing groups can be provided than are required for a production in four-color printing. At the forme cylinders 31, 33 not involved in the running production, or at one or at several forme cylinders 31, 33 of the non-participating printing group, it is possible to perform a change of at least one printing forme 36, 37. In the course of this change, the particular forme cylinder 31, 33 has been moved away from its rubber blanket cylinder 32, 34, so that the forme cylinder 31, 33 is not in contact with the associated rubber blanket cylinder. Instead, both cylinders 31, 32, 33, 34 are separated from each other, for example by a pivot or a travel movement, so far that the change of a printing forme 36, 37 at the forme cylinder 31, 33 is possible without any interference. Alternatively, or additionally, the rubber blanket cylinder 32, 34, which works together with the forme cylinder 31, 33 and with the printing forme 36, 37, can be moved away from the paper web 46, so that it can be brought out of contact. An entire printing group can thus be placed into an operational state which is not involved in the running production in which the rubber blanket cylinders 32, 34, between which the paper web 46 is conducted, are placed away from each other in such a way that the paper web 46 can move between them without coming into contact with the rubber blanket cylinders 32, 34.

In what follows, it is assumed for the sake of simplicity, and without restricting the invention, that at least the forme cylinders 31, 33 are identical in their size and in their structural type. Individual drive mechanisms are preferably assigned to the forme cylinders 31, 33 and to the rubber blanket cylinders 32, 34. While changing a printing forme 36, 37, the number of revolutions of the respective forme cylinder 31, 33 is greatly reduced in comparison with the forme cylinders 31, 33 involved in the production of the printed product, so that the respective forme cylinder 31, 33 rotates very slowly. However, the number of revolutions of the respective forme cylinder 31, 33 can also be reduced to where it is stopped.

The forme cylinder 31 can be covered with a printing forme 36, and the forme cylinder 33 can be covered with a printing forme 37, wherein the printing formes 36, 37 each have, for example, a length L corresponding to the circumference of the forme cylinders 31, 33, and each have a width B corresponding to the length of the respective barrels of the forme cylinders 31, 33. In this case, the printing formes 36, 37 can have, for example, in respect to their width B, four or six printed pages arranged axially side-by-side and, in relation to their length L, two printed pages circumferentially one behind the other, therefore resulting in a total of eight or twelve printed pages. As previously discussed, and as represented in FIGS. 1 and 2, the printing formes 36, 37 have, on their ends, in relation to their length L, beveled suspension legs 13, 14, by the use of which, the printing formes 36, 37 are fastened on the respective forme cylinder 31, 33. As discussed above, these suspension legs 13, 14 are inserted into a slit-shaped opening 09 which is cut into the surface areas of the forme cylinders 31, 33 and extending in the axial direction of the forme cylinders 31, 33 and are held there, if required, by the use of a holding device, which is preferably arranged in a channel in the forme cylinder 31, 33. The opening angle α1 between the beveled suspension leg 13 and the extended length L of the printing forme 36, 37 at the leading end 03 of the printing formes 36, 37 is preferably 45°. At the trailing end 04 of the printing formes 36, 37, the opening angle β1 between the beveled suspension leg 14 and the extended length L of the printing formes 36, 37 is preferably 90°. The slit width S of the opening 09 cut into the forme cylinders 31, 33 preferably is 1 mm to 3 mm.

In a preferred embodiment of the printing press in accordance with the present invention, it is provided that a change of one or of several printing formes 36, 37 on the forme cylinders 31, 33 can be made by remote control from a control console that is assigned to the printing press, while the paper web 46 is running. In particular, a printing forme 36, 37, to which has been assigned a definite color of printing ink, for example black, should be exchangeable without it being necessary to stop the whole printing process. To achieve this goal, a first printing forme magazine 38 which is, for example, arranged underneath the paper web 46, is provided for the forme cylinder 31, and a second printing forme magazine 39 for the forme cylinder 33 is arranged above the paper web 46. Each of the printing forme magazines 38, 39 has at least one chute 41, 42 for receiving a used printing forme 36, 37 to be removed from the respective forme cylinder 31, 33, and at least one chute 43, 44 for receiving fresh printing formes 36, 37 to be mounted on the respective forme cylinder 31, 33. Once the printing forme magazine 36, 39 assigned to the respective forme cylinder 31, 33 has been positioned, for example by the use of a pivot movement against the respective forme cylinder 31, 33 for changing a printing forme 36, 37, the first forme cylinder 31 and the second forme cylinder 33, for example, are moved away from their respective rubber blanket cylinders 32, 34, with which they are in an operative connection. Alternatively, or additionally, the rubber blanket cylinders 32, 34 can be moved away from the paper web 46. In any case, during the change of one or of several of the printing formes 36, 37, the respective forme cylinder 31, 33 is disengaged from the paper web 46. In the remainder of the printing group, the other pairs of cylinders 32, 34 can remain in production.

The chutes 41, 43, or 42, 44 for receiving a used or a fresh printing forme 36, 37, respectively are each advantageously arranged parallel with each other in the respective printing forme magazines 38, 39. As a rule, they are layered or stacked on top of each other. In this case, a separating wall 84, for example, in the respective printing forme magazine 38, 39 can separate the chutes 41, 43 or 42, 44 from each other, as seen in FIG. 5. To make possible satisfactory access to the chutes 41, 43, or 42, 44, even when the paper web 46 is running, for example for removing a used printing forme 36, 37 from the chutes 41, 42, or for making a fresh printing forme 36, 37 available in the chutes 43, 44, these chutes 41, 43, or 42, 44, are accessible, in relation to the running direction of the paper web 46, from a side of the printing forme magazine 38, 39 extending parallel with the paper web 46. Preferably, the printing forme magazines 38, 39 each extend over the width of the barrels of the forme cylinders 31, 33. At least the magazines 38, 39 extend over the width B of the printing formes 36, 37, and are preferably capable of receiving a printing forme 36, 37 completely, i.e. over their lengths L. The chutes 41, 43, or 42, 44 are preferably located in a housing. The housing has an opening o38, o39, which can be aligned parallel with respect to the barrel of the respective forme cylinder 31, 33, and through which opening o39, o39 a printing forme 36, 37 can be fed to the forme cylinder 31, 33, or can be inserted from the forme cylinder 31, 33 into the chute 41, 43. The openings o38, o39 of the printing forme magazines 38, 39 are brought toward the respective forme cylinders 31, 33 at a substantially lesser distance a38, a39, in relation to the respective openings 09 in the forme cylinders 31, 33, than the length L of the printing formes 36, 37. Distances a38, a39 of between 2% and maximally 50% of the length L of the printing formes 36, 37 are advantageous. In particular, short distances a38, a39, up to 10% of the length L, are preferred. It is advantageous to support at least the printing forme magazine 39 located above the paper web 46 to be movable, so that, for example, magazine 39 can be moved or pivoted out of a position of rest, preferably located above the printing group, into a working position against the forme cylinder 33. By the movable arrangement of the printing forme magazine 38, 39 an improved accessibility of the printing group results. This facilitates the performance of work required there, such as, for example, maintenance work.

Figure 5:
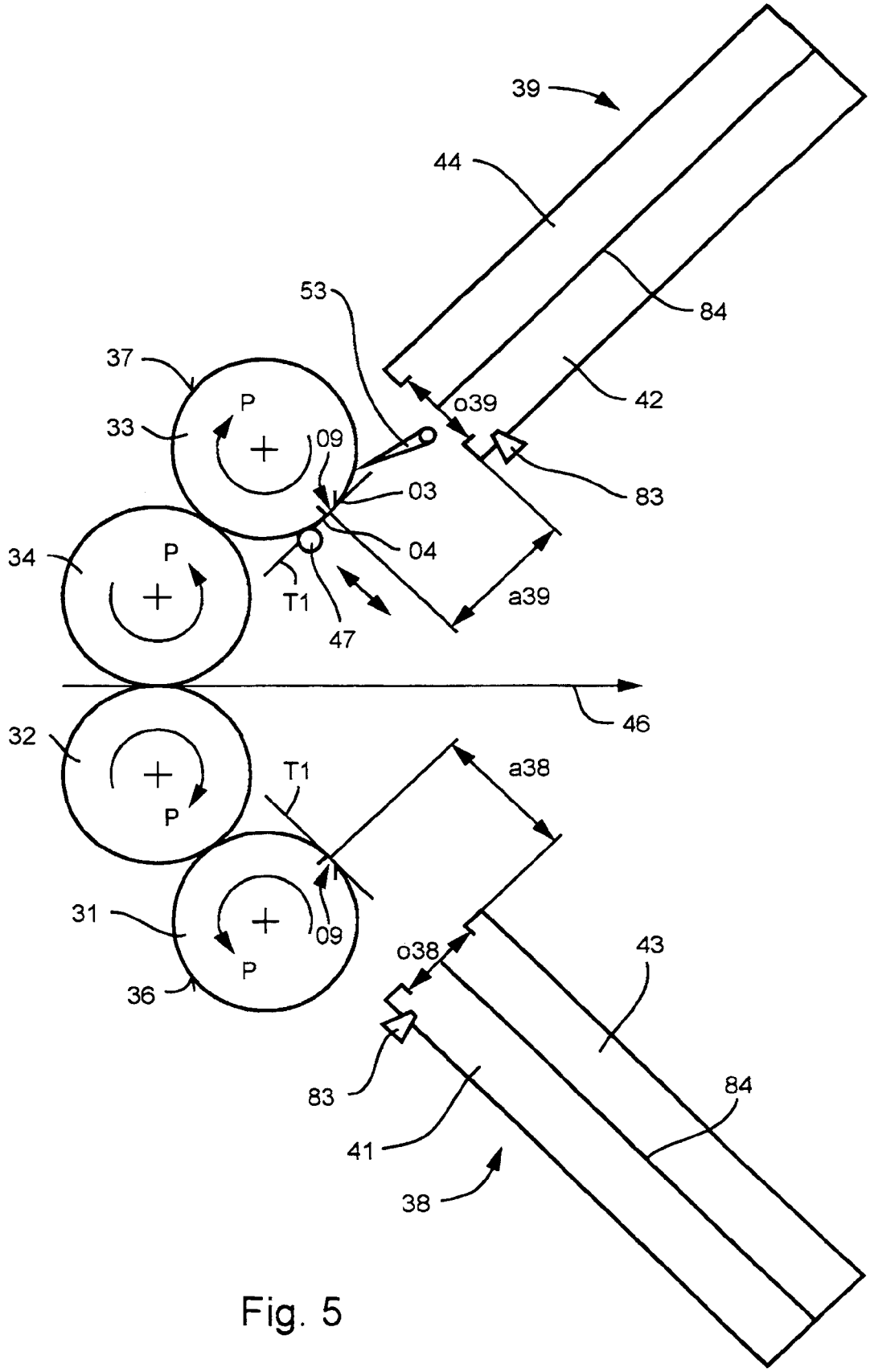

In its work position, a movably arranged printing forme magazine 38, 39 can be fixed in place adjacent to a forme cylinder 31, 33, at its distance a38, a39, and in its orientation by the provision of an arrestment device 83, as seen in FIG. 5. The arrestment device or stop 83 can be provided by a conical bolt 83, for example, which is fixed in place, in reference to the forme cylinder 31, 33, for example, and which conical bolt 83 enters into an opening in the housing of the printing forme magazine 38, 39. This conical bolt 83 centers a printing forme magazine 38, 39, which has been pivoted to the forme cylinder 31, 32, for example, with respect to the barrel of the forme cylinder 31, 33 by its openings o38, o39. The conical bolt 83 has been preferably configured in such a way that, in the course of its entry into the housing of the printing forme magazine 38, 39, no self-locking effect will occur. Instead, an incline is only used for positioning the printing forme magazine 38, 39. With regard to side register, it is advantageous to bring the forme cylinder 31, 32 into a predefined position, with respect to the printing forme magazine 31, 33, for example to put it into a zero position with respect to the side register, before accomplishing an exchange of a printing forme 36, 37 between the forme cylinder 31, 33 and the printing forme magazine 38, 39. Alternatively, is also possible, for setting the forme cylinder 31, 33, to bring the printing forme magazine 38, 39 into a predefined position laterally, with respect to the forme cylinder 31, 33, so that the exchange of a printing forme 36, 37 between the printing forme magazine 38, 39 and the forme cylinder 31, 33 can take place correctly aimed and without lateral offset. For example, the printing forme 38, 39 can be brought into a predefined position laterally, in relation to the forme cylinder 31, 33, so that the printing forme magazine 38, 39 is placed in a lateral position free of play. This can take place wherein the printing forme magazine 38, 39 is introduced, preferably with at least a front area oriented toward the forme cylinder 31, 33, into a gap extending axially with respect to the forme cylinder 31, 33. The gap has lateral boundaries which are stationary with respect to the frame of the printing press.

Without restricting the invention by this, in what follows it is assumed that the second printing forme magazine 39, which is arranged above the paper web 46 and which can be placed against the forme cylinder 33, has two chutes 42, 44, which are arranged parallel and which are situated on top of each other, namely a lower chute 42 for receiving printing forme 37 to be removed, and an upper chute 44 for making a fresh printing forme 37 available. Both of these two chutes 42, 44 are spaced only slightly apart from each other in the printing forme magazine 39. The printing forme 37 located in a lower chute 42 is preferably spaced apart from a printing forme 37 located in the other, upper chute 44 of the same printing forme magazine 39 by 30 to 40 mm, for example, and preferably by even less, because of which small distance of separation, a very flat structural shape of the printing forme magazine 39 is achieved, which flat, structural shape is very advantageous.

To remove a used printing forme 37, the printing forme magazine 39 is pivoted in front of the forme cylinder 33 and is fixed in place there in such a way that at least the input area of the chute 42 for receiving the used printing forme 37 is preferably directed tangentially toward the surface area of the forme cylinder 33. The forme cylinder 33 is rotated until an imaginary tangential line T1, which rests on the slit-shaped opening 09 of the forme cylinder 33, is either aligned with the chute 42 for receiving the printing forme 37 to be removed, or at least extends parallel with this chute 42. As long as no element of the printing forme magazine 39 acts in a pushing or in a pulling manner on the printing forme 37, the rotating forme cylinder 33 alone will convey the used printing forme 37 being removed into the printing forme cylinder 39. The entire process of the removal of a used printing forme 37 from the forme cylinder 33 can then be advantageously controlled by an electric control device, and would preferably be remotely controlled from a control console which is assigned to the printing press.

Preferably at the start of the process for the removal of a used printing forme 37 from the forme cylinder 33, or at least as soon as the trailing end 04 of the printing forme 37 has reached the opening o39 of the printing forme magazine 39, and in particular, if the rubber blanket cylinder 34 has been moved away from the forme cylinder 33, a rolling element 47 which, for example, can consist of a plurality of rolls arranged side-by-side in the axial direction, is placed against the forme cylinder 33 at a distance from its opening 09 in the production direction P of the forme cylinder 33. The printing forme 37 is thus pushed against the forme cylinder 33 not far from its trailing end 04. The holding device in the forme cylinder 33 releases the trailing end 04 of the printing forme 37 and, because of the elasticity of the printing forme 37, this trailing end 04 springs out of the opening 09. At this time, the leading end 04 of the printing forme 37 typically still rests, in a positively connected manner, against the front edge 16 of the opening 09, which lies in front, in the production direction P.

Subsequently, the forme cylinder 37 rotates counter to its production direction P until the trailing end 04 of the printing forme 37 has been introduced into the chute 42 which is provided for receiving the printing forme 37 to be removed. The trailing end 04 of the printing forme 37 is snapped in place in chute 42, in a positively connected manner, onto a holding element 48, as seen in FIG. 6, preferably by a contact over the entire surface of the beveled suspension leg 14 with the holding element 48, and wherein the holding element 48 is embodied as a ratchet 48, also as seen in FIG. 6. Thus, the holding element 48, i.e. the ratchet 48, is hooked on the beveled suspension leg 14 at the trailing end 04 of the printing forme 37. The holding element 48 is connected with a first conveying device 49, which is assigned to the chute 42 for receiving the printing forme 37 to be removed. This first conveying device 49 is preferably a linear drive mechanism, for example, which is assigned to the chute 42 for receiving the printing forme 37 to be removed, and which pulls a hooked-on used printing forme 37 into the chute 42.

In a preferred embodiment, the first conveying device 49 has a carriage 51, to which the holding element 48 is attached, for example pivotably by the provision of a joint, as further depicted in FIG. 6. In the course of its rotation in a direction which is counter to its production direction P, the forme cylinder 33 pushes the trailing end 04 of the printing forme 37 to be removed into the chute 42 for receiving the printing forme 37 to be removed. The suspension leg 14 beveled or angled off on this trailing end 04 of the printing forme 37 is pushed against a stop 52 which, for example, is formed on the carriage 51 or is attached to carriage 51. The stop 52 is positioned in the chute 42 in such a way that, because of the trailing end 04 of the printing forme 37 being pushed against the stop 52, the leading end 03 of the printing forme 37 is pushed out of the opening 09 in the forme cylinder 33. The stop 52 is initially arranged in the chute 42 at a distance from the opening 09 in the forme cylinder 33 such that a printing forme 37 to be removed from the forme cylinder 33 is pushed, just before its entire length L has been completely removed from the forme cylinder 33, and with its suspension leg 14 at the trailing end 04, against the stop 52. This releases the suspension leg 13 at the leading end 03 of the printing forme 37, which was preferably maintained at the front edge 16 of the opening 06 by a positive connection and not by a holding element 21, from the opening 09 by a transmitted pulse or force and without utilizing or relying on the elasticity of the leading end 03 of the printing forme 37. Thus, the positively connected contact of the plate leading end suspension leg 13 is terminated by a short jolt acting along the length L of the printing forme 03.

The holding element or ratchet 48 engaged with the trailing end 04 of the printing forme 37 is snapped together with the stop 52 because of the jolt. The holding element 48 can be embodied to be wedge-shaped, for example, and the tip of the wedge can be oriented toward the opening of the chute 42, as seen in FIG. 6, so that, in the course of the conveying movement of the used printing forme 37 the trailing end 04 of the printing forme 37 initially lifts the holding element 48 against a force, such as, for example, the force of the weight of the holding element 48, or against a spring force of a spring which is operatively connected with the holding element 48, until the beveled suspension leg 14 at the trailing end 04 of the printing forme 37 extends behind the holding element 48 and grips it. The holding element 48 is then again lowered into its initial position. The jolt of the trailing end 04 of the printing forme 37 against the stop 52 can trigger a control signal, by the use of which control signal, the carriage 51 of the first conveying device 49 is put into motion for conveying the printing forme 37 completely into the chute 42. The used printing forme 37 can thereafter be taken out of the side of the chute 42. Removal of this used printing forme 37 can be made easier because an ejector, that is not specifically shown, is preferably provided in the printing forme magazine 39, which ejector conveys the used printing forme 37 laterally sufficiently far out of the chute 42 so that the printing forme 37 can be grasped. Reaching into the chute 42 is thus not necessary.

In the meantime, the rolling element 47 which was placed against the forme cylinder 33 has been moved away from the forme cylinder 33. This is done preferably immediately prior to the leading end 03 of the printing forme 37 being expelled from the opening 09 in the forme cylinder 33. The rolling element 47 had been placed, non-positively connected, against the forme cylinder 33 in such a way that it aided the conveying of the used printing forme 37 during the rotation of the forme cylinder 33. For example, the carriage 51 of the first conveying device 49 can be guided in laterally installed rails or ball boxes. It is also advantageous to arrange a hingedly seated, and preferably pivotable guide plate 53 near the forme cylinder 33 and in front of the opening of the printing plate magazine 39, which guide plate 53 can be oriented toward the forme cylinder 33, as is shown in FIG. 5. By the use, by means of this guide plate 53, a trailing end 04 of the printing forme 37, which was released from the opening 09 in the forme cylinder 33, can be conducted in an accurately guided manner to the chute 42 for receiving the printing forme 37 to be released. In particular, by use of the guide plate 53, it is possible to block an erroneous access of a used printing plate 37 to be removed from the forme cylinder 33 to the chute 44, in which a fresh printing forme 37 can be held ready.

Figure 7:
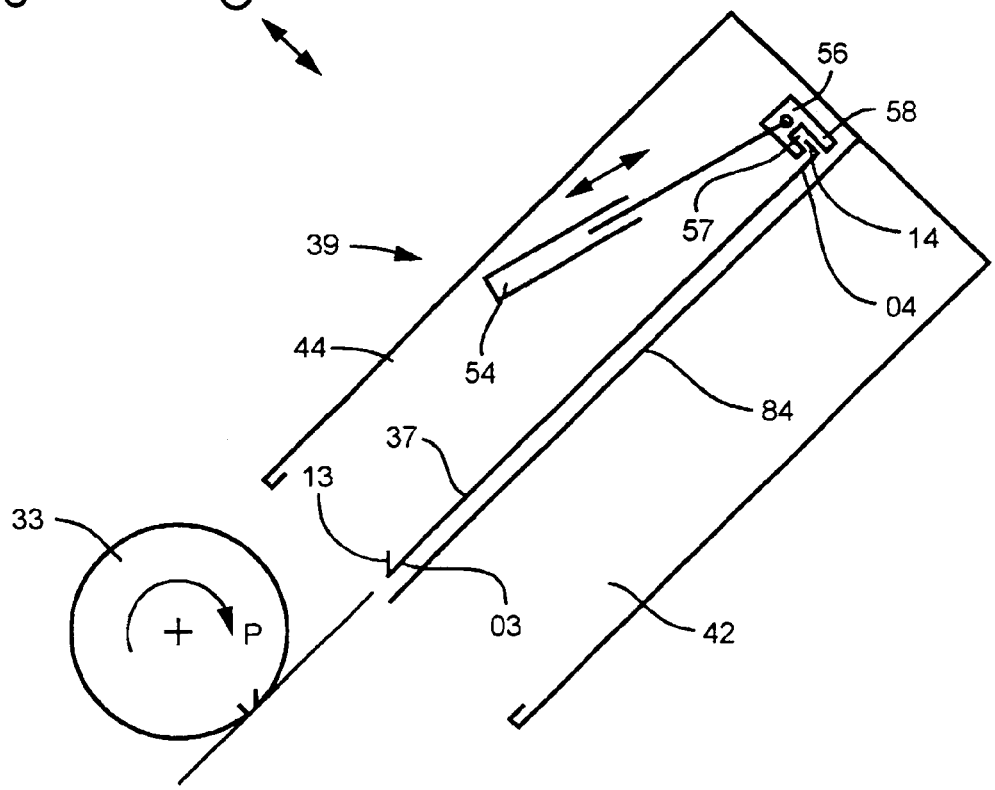

In preparation for the mounting of a fresh printing forme 37 on the forme cylinder 33, the printing forme 37 to be mounted is placed into the upper chute 44 of the printing forme magazine 39, preferably from a side which is easily accessible during the printing process. Thereafter, it is possible to put the mounting of the fresh printing forme 37 onto the forme cylinder 33, which forme cylinder 33 must be free for this printing forme 37, i.e. unoccupied, into motion by the use of an electric control which is assigned to the printing press, preferably by the use of a control console. A second conveying device 54, which is assigned to the upper chute 44 for making available the fresh printing forme 37, is put into motion, and preferably is triggered by a control signal output from the control console, to push the fresh printing forme 37 forward out of the chute 44 of the printing forme magazine 39 in the direction of the forme cylinder 33, as shown in FIG. 7. The second conveying device 54 can be a pneumatic linear drive mechanism, for example, which is particularly advantageously configured as an inclined lifting device for a printing forme 37, and which is arranged hanging in the chute 44, as is the case in the printing forme magazine 39 arranged above the paper web 46. This, which means that the second conveying device 54 has a carriage 56, for example with a groove 57, into which groove 57 the beveled suspension leg 14 on the trailing end 04 of the fresh printing forme 37 enters, preferably in the course of placing this printing forme 37 into the chute 44 of the printing forme magazine 39. In the course of pushing the printing forme 37 out of the chute 44, the carriage 56 does not move parallel with respect to the printing forme 37, but instead is continuously farther removed from the printing forme 37. The beveled suspension leg 14 at the trailing end 04 of the fresh printing forme 37 is thus eventually released from the groove 57 while the carriage 56 conveys the printing forme 37 out of the chute 44. Thus, the conveying direction of the second conveying device 54 can form an opening angle with the printing forme 37 of less than 30°, and preferably of from 15° to 20°. This selected opening angle is then fixed during the conveying and cannot be changed. Conveying of the printing forme 37 can be aided by a stop 58 which is formed on the carriage 56 or which is attached there. The stop 58 pushes against the suspension leg 14 of the trailing end 04 of the fresh printing forme 37.

Figure 8:
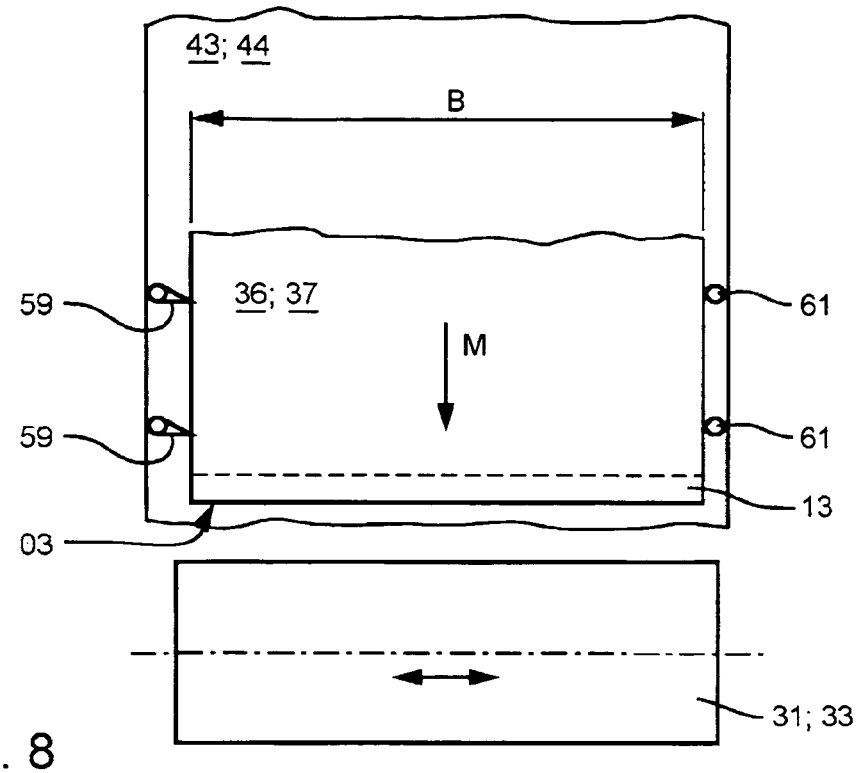

The fresh printing forme 37 is pushed, with its leading end 03 against the forme cylinder 33, preferably tangentially, by the second conveying device 54 until the suspension leg beveled off at this leading end 03 rests on the surface area of the forme cylinder 33. While the fresh printing forme 37 is being moved out of the chute 44 in its mounting direction M, the printing forme 37 is also being conducted by a pusher 59, or at least by a lever 59, which is arranged laterally in the chute 44, which is hingedly seated, and which, in particular, is pivotable, against a one- or a multi-part, undeformable lateral stop 61, which is arranged opposite the pusher 59 or the lever 59 and which is fixed in place in the chute 44, so that the printing forme 37 is definitely aligned in its mounting direction M, and is therefore also definitely aligned in the axial direction with respect to the forme cylinder 33, as seen in FIG. 8. Several pushers 59 or levers 59 can also be provided in the chute 44, which can be particularly advantageous in connection with printing formes 37 of great length L. The forme cylinder 33 is also advantageously put into a predefined position with respect to the side register, in that it is put into a zero position with respect to the side register, before the fresh printing forme 37 is applied to it. The pivot axis of the levers 59 is preferably arranged vertically in respect to the support surface 02 of the printing forme 37. Preferably, the at least one lever 59 acts intermittently laterally on the printing forme 37. The placing into contact of the lever 59 occurs, for example, by the use of an actuating device, in particular a pneumatically operated actuating device, against the force of a spring. In the course of being put into contact, the lever 59 is pulsatingly deflected, so that it provides a push only over a short period of time, so that the printing forme 37 can otherwise be moved unhindered in its mounting direction M, for example. Since the lever 59 only acts for a short time on the printing forme 37, the printing forme 37 can be again conveyed into the chute 44 if needed, without the lever 59 hindering a movement of the printing forme 37 counter to its mounting direction M. The pusher 59 or lever 59 is preferably activated for the purpose of aligning the printing forme 37 at the time the printing forme 37 is conveyed out of the chute 44. If a further stop 63 is provided, in the mounting direction M of the printing forme 37, the lever 59 can then press against the side of the printing forme 37 and can align it in the axial direction, in relation to the forme cylinder 33, while the printing forme 37 rests against the further stop 63. By the uses of a lever 59, which is laterally deflected by a pneumatically actuated device against a printing forme 37 of a width B, which width B is variable within defined tolerance limits, a force of identical size, regardless of the actual width measurement of the printing forme 37, is always placed against the printing forme 37.

Even before the leading end 03 of the printing forme 37 reaches the forme cylinder 33, a rolling element 62 is placed against the forme cylinder 33, and a stop 63 is conducted close to the forme cylinder 33, as shown in FIG. 8. The rolling element 62 can consist of a plurality of rolls arranged side-by-side in the axial direction. The stop 63, which can also consist of a plurality of rolls arranged side-by-side in the axial direction, is arranged, in the mounting direction M of the printing forme 37, in front of or before the rolling element 62, or at the side of the rolling element 62. The stop 63 has an inclined face 64 facing the forme cylinder 33, whose imaginary straight-line extension intersects the surface area of the forme cylinder 33 at an intersection point C. An imaginary third tangent line T3 rests on the surface area of the forme cylinder 33 at the intersection point C, with which the inclined face 64, or its imaginary extension, forms an acute angle δ, which is open in the direction toward the printing forme 37 conducted to the forme cylinder 33. The stop 63 can be configured as a wedge, for example, which is fixedly connected with a support for the rolling element 62. The leading end 03 of the fresh printing forme 37, being brought against the forme cylinder 33, comes into contact with the inclined face 64 of the stop 63, because of which, the printing forme 37 is aligned with respect to the forme cylinder 33. The previously described lateral alignment of the printing forme 37, by the use of the levers 59, can also take place only at the end of conveying the printing forme 37 out of the chute 44 if the leading end 03 of the printing forme 37 already rests against the stop 63.

The leading end 03 of the fresh printing forme 37, which has been brought against the forme cylinder 33, is fed to the surface area of the forme cylinder 33 in such a way that the suspension leg 13, beveled off at the leading end 03 of the printing forme 37, is pressed against the surface area of the forme cylinder 33 and rests on it. The opening angle αl between the beveled suspension leg 13 and the extended length L of the printing forme 37 can be slightly reduced because of the pressure exerted by the stop 63 on the leading end 03 of the printing forme 37 in the direction of the forme cylinder 33. Since the suspension leg 13, which is beveled at an opening angle α1 of preferably 45° at the leading end 03, has a length I13 in the range between 4 mm to 11 mm, for example, in particular in the range between 4 mm to 8 mm, and preferably of 6 mm, the leading end 03 of the printing forme 37 is located close to the surface area of the forme cylinder 33, or close to a fourth tangential line T4 resting on the forme cylinder 33 at the contact point of the suspension leg 13. The distance a37 is from 2.5 mm to 6 mm, for example. The rolling element 62, which has been placed, together with the stop 62, against the forme cylinder 33, has a radius r62, which has been selected to be slightly larger than the measurement of the distance a37. For example, the radius r62 lies within the range of 5 mm to 15 mm, and preferably is at 10 mm.

For mounting the printing forme 37, the forme cylinder 33 is rotated until the suspension leg 13 beveled off on the leading end 03 of the printing forme 37 can be placed on the surface area of the forme cylinder 33 at a distance a09, in the production direction P of the forme cylinder 03, behind the rear edge 16 of the opening 09. The distance a09 is less than an arched segment of the length of a quarter, and in particular of one-eighth, of the circumference of the cylinder 06. The distance a09 is preferably clearly less than the length of the circumference of the rolling element 62. A preferred embodiment of the present invention provides that the suspension leg 13, beveled off at the leading end 03 of the printing forme 37, is placed at a distance a09 of between from 5 mm to 10 mm behind the opening 09.

While the forme cylinder 33 continues to rotate in its production direction P, the suspension leg 13 beveled off at the leading end 03 of the printing forme 37 is hooked in the opening 09 of the forme cylinder 33, aided by a force FR directed radially with respect to the forme cylinder 33. The force FR directed radially with respect to the forme cylinder 33 is correlated with the pressure with which the leading end 03 of the printing forme 37 is pressed against the forme cylinder 33. That pressure is the result of a contact pressure exerted by the stop 63 and can be increased by the inherent weight FG of the printing forme 37, or in that the leading end 03 of the printing forme 37 is elastically prestressed with an effective direction against the forme cylinder 33.

Figure 10:
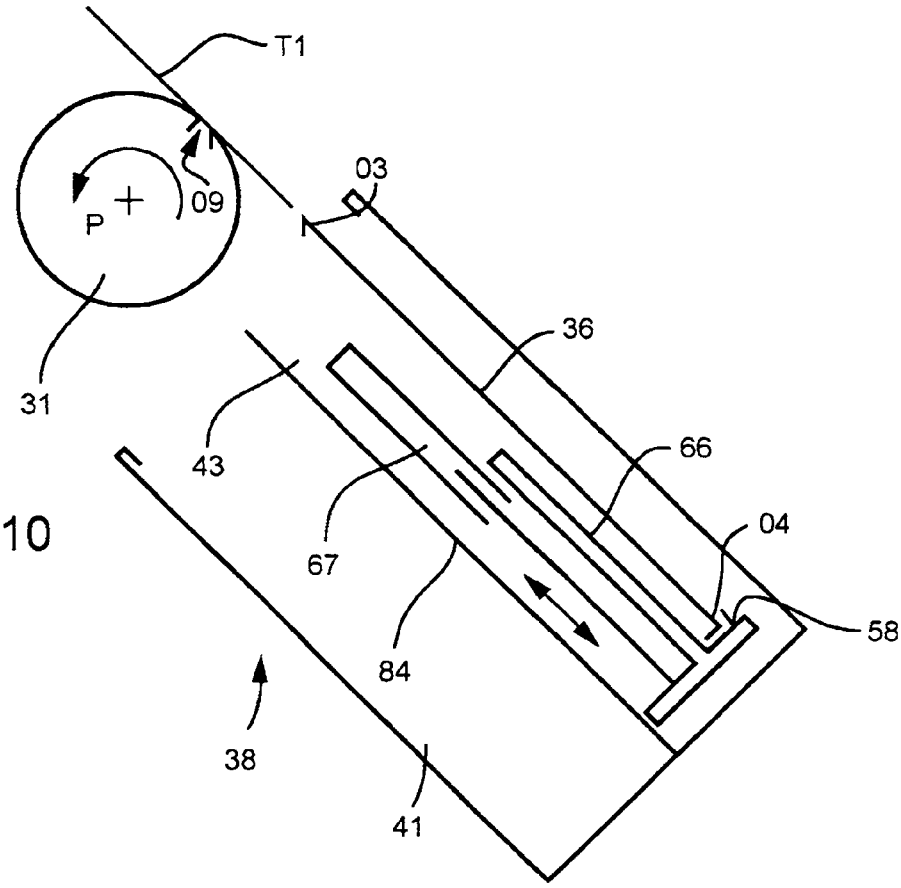

Different from the above described preferred embodiment of the printing forme magazine 39 arranged above the paper web 46, is an embodiment in which the printing forme magazine 38 is arranged underneath the paper web 46, and the printing forme 36 in the chute 43 which is used for making the fresh printing forme 36 available, rests partially, over preferably between 30% and 50% of its length L, on a support 66, as seen in FIG. 10. The printing forme 36 is maintained by its inherent weight, preferably frictionally connected, on the support 66. Because of this, it is not necessary to employ external energy for use in holding the printing forme 36 on its support 66, such as, for example, by a suction device charged with a vacuum, which fixes the printing forme 36 in place on the support 66. The support 66 can be moved by a third conveying device 67, which can be configured as a pneumatic linear drive mechanism, and with whose aid the fresh printing forme 36 can be pushed with its leading end 03 against the force of gravity upward, preferably tangentially with respect to the forme cylinder 31. To this end, the suspension leg 14 at the trailing end 04 of the printing forme 36 preferably again rests against a stop 58, which can be applied to the support 66 or can be formed on it. If the printing forme 36 is conveyed, against the force of gravity, against the forme cylinder 31, a member, corresponding to the stop 63, can be omitted. Thus, the third conveying device 67 is, in the same manner as the second conveying device 54, preferably configured as a translatory conveying device, which performs a displacement path.

In the printing forme magazine 39 which is arranged above the paper web 46, the suspension legs 13, 14 of the printing forme 37 point upward, and the printing forme 37 can be arranged hangingly suspended in the chute 44, because the suspension leg 14 attached to the trailing end 04 of the printing forme 37 is held on the carriage 56 of the second conveying device 54, as seen in FIG. 7, while in the printing forme magazine 38 arranged underneath the paper web 46 the suspension legs 13, 14 of the printing forme 36 point downward, i.e. toward the support 65 for the printing forme 36, as seen in FIG. 10.

Figure 11:
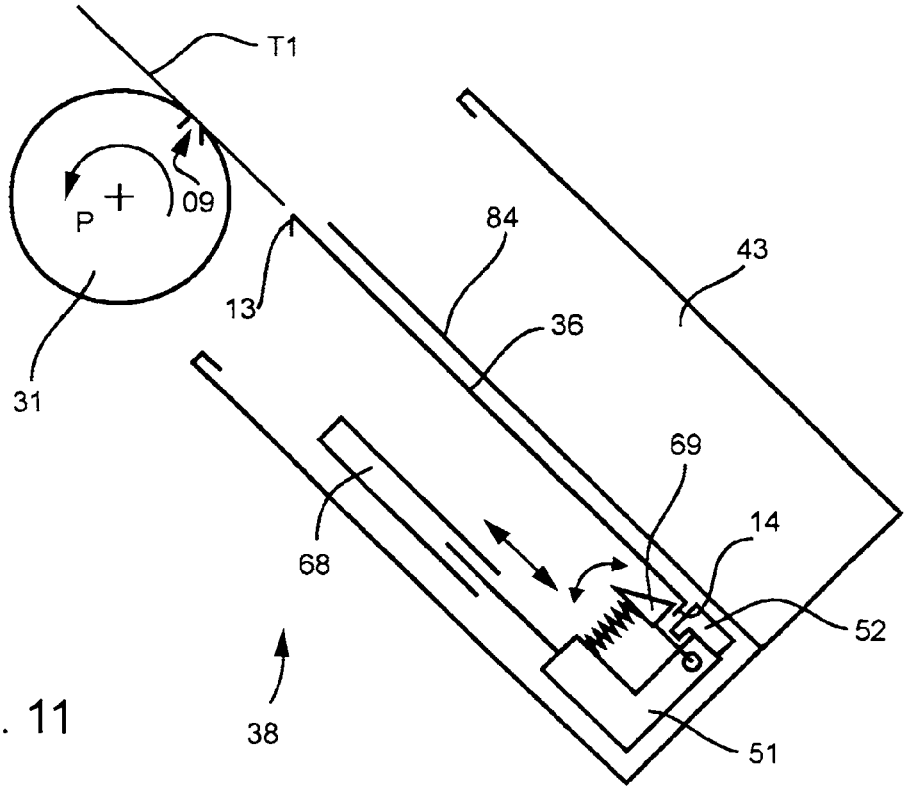

Corresponding to the preferred embodiment, which was described for the printing forme magazine 39 arranged above the paper web 46, a fourth conveying device 68 with a hingedly, and in particular with a pivotably seated holding element 69, such as, in particular, a ratchet, can be provided in the printing forme magazine 38, arranged underneath the paper web 46, in the chute 41 for receiving a printing forme 36 to be removed from the forme cylinder 31. The holding element 69 at the suspension leg 14 of the trailing end 04 of a used printing forme 39, which used printing forme 39 is wound off the cylinder 31, by the rotation of the forme cylinder 31, and which is pushed into the chute 41, is hooked and pulls it preferably completely into the chute 41 because of the movement of the fourth conveying device 68, as seen in FIG. 11.

Figure 12:
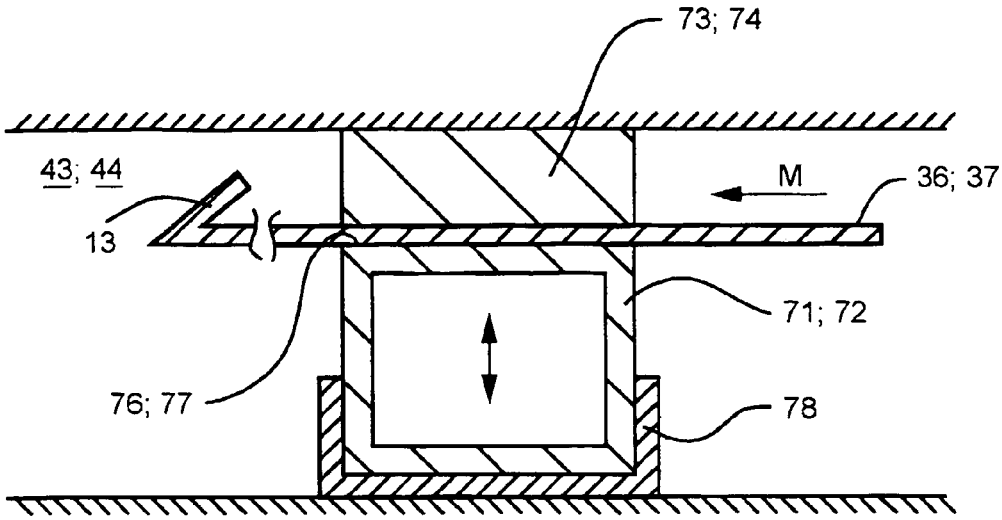

It is advantageous to provide at least one friction body 71, 72 in each of both of the printing forme magazines 38, 39 in the chutes 43, 44 for use in making available a fresh printing forme 36, 37, which friction body 71, 72, in particular 31, 33, then presses the fresh printing forme 36, 37 against a corresponding abutment 73, 74, as see in FIG. 12 at least when the suspension leg 13 on the leading end 03 of the printing forme 36, 37 has been hooked on the front edge 16 of the opening 09 in the forme cylinder 31, 33. The friction bodies 71, 72 and their abutments 73, 74 are preferably arranged in the chutes 43, 44 vertically with respect to the conveying direction of the printing formes 36 37 so that, because of their contact pressure exerted on the printing formes 36, 37, they hold the respective printing forme 36, 37 in a defined position, such as if with cheeks, while the respective printing forme 36, 37 is pulled by the rotating forme cylinder 31, 33 onto the respective forme cylinder 31, 33. Because the fresh printing forme 36, 37 is pulled onto the respective forme cylinder 31, 33 against the contact pressure exerted by the friction bodies 71, 72 and abutments 73, 74, the printing forme 36, 37 lies more tautly on the forme cylinder 31, 33. Because of this, it is also assured that the printing forme 36, 37 rests, free of play, against the front edge 16 of the opening 09 of the forme cylinder 31, 33. Incidentally, the friction bodies 71, 72 can also be used for applying a bending stress to the printing forme 36, 37, in the manner previously described in connection with the support element 43. Thus, the friction bodies 71, 72 can take on the function of a brake or of a holding device and can be of importance, in particular in connection with chutes 43, 44 which have been placed inclined with respect to the force of gravity, against a forme cylinder 31, 33.

In a preferred embodiment of the present invention, the friction body 71, 72 is arranged in the chutes 43, 44 in such a way that the friction body 71, 72 acts against the side of the printing forme 36, 37, which is provided with a print image. In order to prevent damage to the printing forme 36, 37, and to its print image, by the contact pressure which can be exerted by the friction body 71, 72, the friction bodies 71, 72 have a friction surface 76, 77, which is preferably smooth and which is of lesser hardness than the surface of the printing formes 36, 37 facing the friction bodies 71, 72. The friction bodies 71, 72 preferably are made of a reversibly deformable hollow body, such as, for example, a tube which can be filled with a pressure medium, for example compressed air. The tube is preferably made of an elastomeric material, such as, for example, rubber. The abutments 73, 74 can be embodied, for example, as one or as several rails made of plastic with a surface on which the bodies can preferably slide. However, the friction bodies 71, 72 can also be arranged on a conveying device, which conveys the printing formes 36, 37 in the chutes 43, 44, such as, for example, on the carriage-like support 66, and can hold at least one of the printing formes 36, 37, when needed. Thus, the friction bodies 71, 72 can also be placed against a printing forme 36, 37 which is conveyed into the chute 43, 44.

In the course of being charged with a pressure medium, the friction bodies 71, 72, which are preferably embodied as hollow bodies, increase their volume and exert a surface pressure on a printing forme 36, 37 resting against them. The printing forme 36, 37 is supported, on the forme back, by one of the abutments 73, 74, that are preferably made of plastic. The intensity of the surface pressure is preferably controllable by the pressure medium. Since the elastomeric material of the friction bodies 71, 72, as well as the plastic material of the abutments 73, 74, have a lesser hardness than the printing formes 36, 37, which are typically made of a metallic material, and, in particular, are made of an aluminum alloy, damage to the printing formes 36, 37 when the printing formes 36, 37 are pulled, under the existing surface pressure, out of the chute 43, 44 need not be feared.

The friction bodies 71, 72, and their abutments 73, 74 are arranged in the chutes 43, 44 preferably near the respective openings of the chutes 43, 44. They are thus close to the place where a fresh printing forme 36, 37, which is made available in the chutes 43, 44 for mounting on the forme cylinder 31, 33, leaves the respective printing forme magazine 38, 39. The friction bodies 71, 72 and their abutments 73, 74 are arranged in the chutes 43, 44, for example, parallel with respect to the width B of the printing forme 36, 37. The friction bodies 71, 72, preferably embodied as hollow bodies, can be seated in a strip 78 with a U-shaped profile, for example, in which the U-shaped profile is preferably open at the side facing the printing forme 36, 37. The U-shaped profile laterally enclosing the hollow body, lends stability to the hollow body and directs its increase in volume, caused by its being charged with compressed air, purposely against the printing forme 36, 37.

Figure 13:
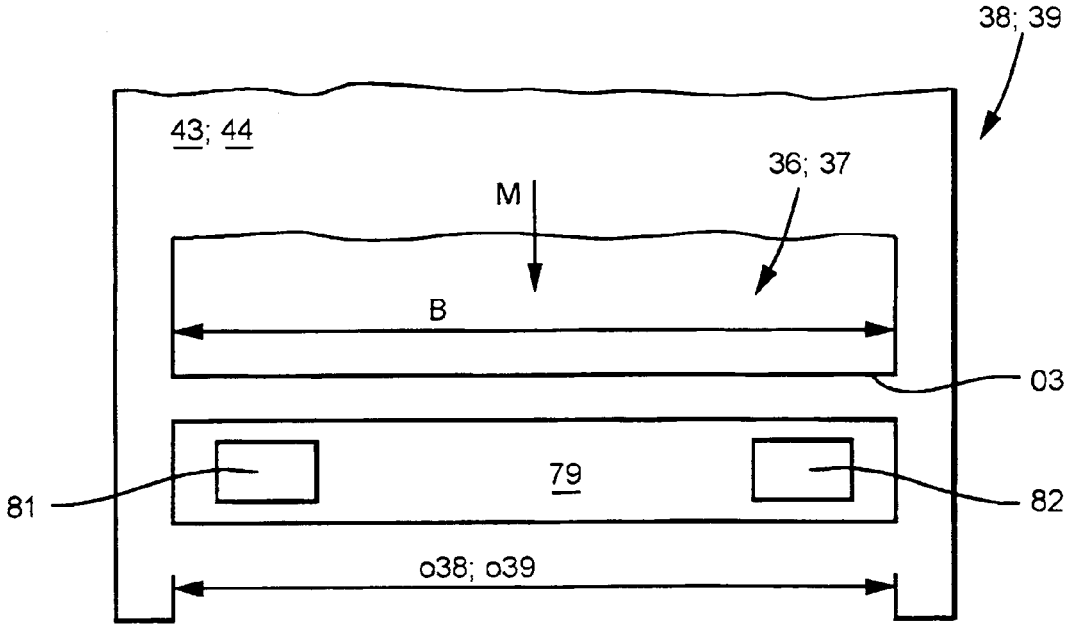

One embodiment of the friction bodies 71, 72 consisting of a hollow body provides, as seen in FIG. 13, for the hollow body to be conducted over the width B of the printing forme 36, 37 in a channel 79 extending over the width B of the printing forme 36, 37. The channel 79 is configured having openings 81, 82, which openings are spaced apart from each other and which are oriented toward the printing forme 36, 37. For example, two such openings 81, 82, in particular, can be provided and through which the hollow body 71, 72 can exert a surface pressure on the printing formes 36, 37 when it is charged with a pressure medium. If the friction bodies 71, 72 are embodied as hollow bodies extending preferably over the entire width B of the printing forme 36, 37 it is assured that, when the hollow bodies are charged with a pressure medium, a uniform surface pressure, preferably over the entire width B of the printing forme 36, 37, results.

The surface pressure exerted by the friction body 71, 72 is released by exhausting, in particular by emptying, the friction bodies 71, 72, which are embodied as hollow bodies, by suction, because of which exhausting, the volume of the hollow bodies is reduced before the suspension leg 14, arranged at the trailing end 04 of the printing forme 36, 37, passes the place of surface pressure in the course of moving the printing forme 36, 37 out of the chute 43, 44. Therefore, the surface pressure only acts for a short time.

Furthermore, further guide elements for accomplishing a dependable, and in particular, a slightly braked transport and a support of the printing forme 36, 37, free of play to a large extent, can be provided in the chutes 41 to 44 on those sides of the chutes which face the surface of the printing forme 36, 37. Brush arrangements are particularly suitable for this use, which brush arrangements do not damage the sensitive surfaces of the printing formes 36, 37.

It is also advantageous, for providing as simple and unhindered mobility as possible of the printing forme magazines 38, 39, to configure the printing forme magazines 38, 39 in such a way that only a single connecting element is provided on each such printing forme magazine 38, 39, which single connecting elements combines all of the required connecting lines in a bundle for providing the printing forme magazine 38, 39 with electrical and other energy, depending on the units installed in them, as well as for performing the exchange of control signals. Alternatively to the above-described, preferably pneumatic drive mechanisms of the conveying devices 49, 54, 67 and 68, as well as other units, electric drive mechanisms and an electric control can also be provided for these devices and units.

While preferred embodiments of a method for changing at least one printing plate and a printing press comprising several plate cylinders, in accordance with the present invention, have been set forth fully and completelyl hereinabove, it will be apparent to one of skill in the art that various changes in, for example, the overall sizes of the cylinders, the supply of the fluid under pressure, and the like could be made without departing from the true spirit and scope of the present invention which is accordingly to be limited only by the appended claims.

What is claimed is:

1. A printing press comprising:

at least a first printing group including a first pair of cylinders rolling off on each other and including a first forme cylinder and a first rubber blanket cylinder, and a second pair of cylinders rolling off on each other and including a second forme cylinder and a second rubber blanket cylinder, a material to be printed being passed between said first and second rubber blanket cylinders;

means separating at least one of said first and second forme cylinders from its associated one of said first and second rubber blanket cylinders during a change of a printing forme on said one of said first and second forme cylinder during a production run of said printing press;

a first printing forme supporting chute assigned to said first forme cylinder;

a second printing forme supporting chute assigned to said second forme cylinder;

a work position for each said chute adapted to change a printing forme on said associated one of said first and second forme cylinders and defined by said chute's distance and orientation in respect to an associated one of said forme cylinders;

a rest position for each said chute;

means moving one of said chutes into said work position adjacent said forme cylinder separated from its associated one of said rubber blanket cylinders; and means moving another of said chutes associated with one of said forme cylinders in production to said rest position.

2. The printing press of claim 1 wherein during said change of said one forme cylinder, said rubber blanket cylinder associated with said forme cylinder whose printing forme is being changed is separated from said material to be imprinted.

3. The printing press of claim 1 further including a plurality of said printing groups arranged in a running direction of said material to be printed, each of said plurality of printing groups having one of said first chutes and said second chutes.

4. The printing press of claim 3 wherein during said production run, said one of said chutes associated with said forme cylinder undergoing a plate change is in said working position and wherein said chutes assigned to forme cylinders in production are in said rest position.

5. The printing press of claim 3 further including at least five of said printing groups, wherein during said production operation said first and second chutes of at least four of said at least five printing groups are arranged in said rest position and said first and second chutes of at least one of said at least five printing groups are in said working position.

6. The printing press of claim 5 wherein each said rubber blanket cylinder associated with one of said forme cylinders having one of said chutes in said work position is separated from said material to be printed.

7. The printing press of claim 3 further including at least one additional printing group more than required for said production, one of said chutes being brought to at least one of said forme cylinders of said at least one additional printing group in said work position.

8. The printing press of claim 7 wherein in said at least one additional printing group, one of said chutes is brought into said work position with respect to said first and second forme cylinder of said at least one additional printing group.

9. The printing press of claim 3 wherein said first chute assigned to each said first forme cylinder is above the material to be printed and said second chute assigned to each said second forme cylinder is beneath the material to be printed in each said printing group.

10. The printing press of claim 9 wherein each said chute above the material to be printed can be moved between said working position and said rest position.

11. The printing press of claim 10 wherein in each said position of rest and working, each said chute is arranged at a distance in front of said associated one of said forme cylinders, said distance being less than a length of said printing forme.

12. The printing press of claim 3 wherein said rubber blanket cylinder of each said printing groups transfer a print image of different colored printing ink to the material to be printed.

13. The printing press of claim 3 further including at least five said printing groups, said first chute and said second chute of at least four of said at least five printing groups being in said rest position, a first chute and a second chute of at least one of said at least five printing groups being in said work position.

14. The printing press of claim 1 further including a central control device for said printing press, said central control device being adapted to remotely control said change of said at least one printing forme by causing said one of said chutes engaged in a change of said printing forme to move to said working position and to change said printing forme from said chute.

15. The printing press of claim 14 wherein said central control device is in a control console for said printing press.

16. The printing press of claim 14 further including a conveying device in each said chute and adapted to convey said printing forme into said chute, said conveying device being controlled by said central control device.

17. The printing press of claim 1 further including a printing forme magazine, said chute performing said printing forme change being located in said printing forme magazine, said printing forme magazine being adapted to be brought to said forme cylinder undergoing said printing plate change.

18. The printing plate of claim 1 further including at least one additional forme cylinder more than required for said production, one of said chutes being brought to said at least one additional forme cylinder.

19. The printing press of claim 1 wherein said first and second rubber blanket cylinders in each said printing group are arranged substantially above each other.

20. The printing press of claim 1 wherein said first and second rubber blanket cylinders transfer an image to be printed to said material to be printed and wherein said material is a paper web.

21. The printing press of claim 1 wherein each said printing forme has several print image positions.

22. The printing press of claim 21 wherein said several print image positions are different.

23. The printing press of claim 1 further including a separate drive mechanism for each said forme cylinder and each said rubber blanket cylinder.

24. The printing press of claim 1 wherein each of said chutes is adapted to allow removal of a printing forme removed from a respective one of said printing formes from a side of said chute.

* * * * *